US008316491B2

(12) United States Patent
Hayes

(10) Patent No.: US 8,316,491 B2
(45) **Date of Patent: *Nov. 27, 2012**

(54) MATTRESS AND BEDPAN CUSHION SYSTEM USING AN AIR PRESSURE SWITCH AND RELIEF VALVE

(76) Inventor: John Hayes, Bristol, VA (US)

( * ) Notice: Subject to any disclaimer, the term of this patent is extended or adjusted under 35 U.S.C. 154(b) by 1628 days.

This patent is subject to a terminal disclaimer.

(21) Appl. No.: 10/752,709

(22) Filed: Jan. 8, 2004

(65) Prior Publication Data

US 2004/0133986 A1 Jul. 15, 2004

Related U.S. Application Data

(63) Continuation-in-part of application No. 10/231,188, filed on Aug. 30, 2002, now Pat. No. 6,725,485, which is a continuation-in-part of application No. 10/152,794, filed on May 23, 2002, now abandoned, which is a continuation-in-part of application No. 10/032,739, filed on Jan. 2, 2002, now abandoned.

(60) Provisional application No. 60/260,373, filed on Jan. 8, 2001.

(51) Int. Cl.
*A61G 7/00* (2006.01)

(52) U.S. Cl. ..... 5/695; 5/604

(58) Field of Classification Search ..... 5/604–606, 5/695, 710, 713

See application file for complete search history.

(56) References Cited

U.S. PATENT DOCUMENTS

| | | | | |
|---|---|---|---|---|
| 1,054,452 A | | 2/1913 | Sayen | |
| 2,318,240 A | * | 5/1943 | Mas | 5/604 |
| 2,394,091 A | | 2/1946 | Merwin | |
| 2,615,175 A | | 10/1952 | Corakus | |
| 3,146,469 A | | 9/1964 | Slade | |
| 3,605,138 A | | 9/1971 | Tucker | |
| 3,833,945 A | | 9/1974 | Moody | |
| 4,011,610 A | * | 3/1977 | Parker, III | 5/604 |
| 4,122,656 A | | 10/1978 | Shaw | |
| 4,244,066 A | | 1/1981 | Rukawina | |

(Continued)

FOREIGN PATENT DOCUMENTS

NL 7107295 11/1972

(Continued)

OTHER PUBLICATIONS

European Search Report dated Jan. 19, 2007.

*Primary Examiner* — Heather Shackelford
*Assistant Examiner* — Fredrick Conley
(74) *Attorney, Agent, or Firm* — Crowell & Moring LLP

(57) ABSTRACT

A support structure, such as a mattress, is provided for the placement and removal of a human waste container, such as a bedpan, with minimal exertion by the attendant and minimal movement of the person. The mattress is provided with a cavity equipped with a controllable expandable cushion operatively coupled with the cushion to control an expansion and contraction of the cushion, wherein the control system includes a fluidic pump arranged to pump fluid into the expandable cushion, a fluid relief mechanism arranged to allow fluid to escape the expandable cushion, a fluid pressure reservoir for maintaining a relatively constant pressure in the fluidic system, and a fluid pressure switch operable to automatically activate and deactivate the fluidic pump to maintain a defined pressure level in the expandable cushion.

8 Claims, 11 Drawing Sheets

U.S. PATENT DOCUMENTS

| | | | | | |
|---|---|---|---|---|---|
| 4,737,999 | A | | 4/1988 | Halverson | |
| 4,819,287 | A | | 4/1989 | Halverson | |
| 4,847,932 | A | | 7/1989 | Baribault | |
| 4,867,140 | A | * | 9/1989 | Hovis et al. | 601/152 |
| 4,947,500 | A | * | 8/1990 | Seiler | 5/713 |
| 4,998,301 | A | | 3/1991 | Markus | |
| 5,001,790 | A | | 3/1991 | Kuhn | |
| 5,077,845 | A | * | 1/1992 | Tokunaga et al. | 5/605 |
| 5,081,721 | A | | 1/1992 | Stefano | |
| 5,142,717 | A | * | 9/1992 | Everard et al. | 5/709 |
| 5,185,897 | A | | 2/1993 | Van Laanen | |
| 5,193,232 | A | | 3/1993 | Flood et al. | |
| D335,999 | S | | 6/1993 | Driessche | |
| 5,327,599 | A | | 7/1994 | Bradley | |
| 5,350,369 | A | | 9/1994 | Workman et al. | |
| 5,839,130 | A | | 11/1998 | Markus | |
| 5,890,246 | A | | 4/1999 | Davis | |
| 6,000,078 | A | | 12/1999 | Stefano | |
| 6,223,368 | B1 | | 5/2001 | Anslin | |
| 6,243,898 | B1 | | 6/2001 | Ruff | |

FOREIGN PATENT DOCUMENTS

| | | |
|---|---|---|
| WO | WO87/02235 | 4/1987 |

* cited by examiner

MATTRESS AND BEDPAN CUSHION SYSTEM USING AN AIR PRESSURE SWITCH AND RELIEF VALVE

CROSS REFERENCE TO RELATED APPLICATIONS

This application is a continuation-in-part of U.S. patent application Ser. No. 10/231,188, filed Aug. 30 2002, now U.S. Pat. No. 6,725,485 which is a continuation-in-part of U.S. patent application Ser. No. 10/152,794, filed May 23, 2002, now abandoned, which is a continuation-in-part of U.S. patent application Ser. No. 10/032,739, filed Jan. 2, 2002, now abandonded as a continuation of provisional Application No. 60/260,373, filed Jan. 8, 2001.

FIELD OF THE INVENTION

This invention relates to the field of mattresses equipped to accommodate a bedpan system.

BACKGROUND OF THE INVENTION

Conventional bedpan systems pose many problems for the person using the bedpan as well as the attendant helping the person. Such difficulties include rolling the person over on his or her side, placing the bedpan on the bed, rolling the person onto the bedpan for use and off of the bedpan after use. The difficulties associated with rolling the person often lead to the person slipping off the bedpan and onto the mattress, thus soiling the bed linens and the person's garments. Further, if the person is very large or completely immobile, there is a high probability that the attendant may become injured by the physical exertion associated with moving the large or immobile person onto and off of the bedpan. Such problems can cause embarrassing, uncomfortable, and potentially dangerous circumstances for both the person and the attendant.

Various attempts have been made to overcome the problems associated with the use of conventional bedpan systems. Some attempts have included mattresses with cavities for accepting a bedpan. For example, U.S. Pat. Nos. 4,011,610 and 6,243,898 B1 disclose mattresses with plugs which must be manually removed and inserted in order to expose a cavity equipped to accept a bedpan assembly. U.S. Pat. No. 4,122,565 also discloses a mattress with a cavity, the cavity being closed by way of a slidable plug. These attempts do not provide for the careful positioning of the bedpan directly under the person such that the risks of leaks or spills in the cavity or on the person are avoided. Moreover, use of the removable plugs generally disadvantageously requires some movement of the person.

Other attempts have included placing inflatable mattresses or devices equipped to accept a bedpan assembly on top of a conventional mattress. For example, U.S. Pat. No. 5,081,721 discloses an inflatable mattress with an access area to accommodate a bedpan in its middle section. The inflatable mattress is laid upon a standard mattress and, when inflated, lifts the person so that the bedpan can be inserted under him or her. U.S. Pat. No. 6,223,368B1 discloses an inflatable support device which is affixed to a conventional mattress and which can accommodate a bedpan once inflated. With these types of arrangements, the person is deprived of the comforts of a conventional mattress and may be left in an awkward position when on the inflated mattress or device. A still further attempt described in U.S. Pat. No. 5,077,845 uses a complex structure to build a commode into a bed, which is costly and cumbersome.

To overcome the problems associated with the use of conventional bedpan systems, there is needed a mattress and bedpan system which provides for the careful placement of a bedpan directly under a person with minimal movement of the person, minimal physical exertion of the attendant, and minimal risk of leaks or spills on the mattress or person when the bedpan is being used or removed.

SUMMARY OF THE INVENTION

These needs are met in accordance with the present invention which provides a mattress system having a mattress with a top surface and a bottom surface. A cavity is arranged in the mattress. The cavity is open at least toward the top surface (and optionally a lateral side area of the mattress as well) and has a defined size. An expandable cushion is arranged in the cavity. The expandable cushion can advantageously fill the cavity in an expanded state so as to provide a comfortable mattress, and, in a contracted state, allow for a human waster container, such as a bedpan or wastebag, to be inserted (from either the top or the side) into the cavity for use by a person lying on the mattress. This advantageously minimizes, or eliminates, movement of the person in order to facilitate use of the bedpan or wastebag.

In another embodiment of the invention, in order to facilitate the person's personal and private hygiene, the mattress may also be equipped with a bidet system capable of being operable by the person using the bedpan or wastebag. The bidet system permits the release of a fluidic cleaning agent to the part of the person's lower body exposed within the cavity thus permitting the person to clean him or herself immediately after use of the bedpan or wastebag.

In accordance with the present invention, a control system is operatively coupled with the expandable cushion to control the expansion and contraction thereof. In one embodiment, the cushion is an inflatable and deflatable cushion. Of course, other means for expanding the cushion can be used, such as liquid fluids, mechanical measures, or the like. In a preferred embodiment, the control system makes use of an air pressure switch, an air reservoir and an air release mechanism to maintain a relatively constant air pressure in the bladder in accordance with the weight of the user in proportion to the firmness of the adjacent mattress material.

While the present invention is drawn to a mattress, it is applicable to any support structure with a top surface and a bottom surface on which a person may rest or recline. For example, a reclining chair, sofa, seat cushion, or the like may be provided with the cavity cushion system of the present invention. In that regard, it is intended the term mattress is to include any such support structure.

Other objects, advantages and novel features of the present invention will become apparent from the following detailed description of the invention when considered in conjunction with the accompanying drawings.

DETAILED DESCRIPTION OF THE DRAWINGS

Figure 1:
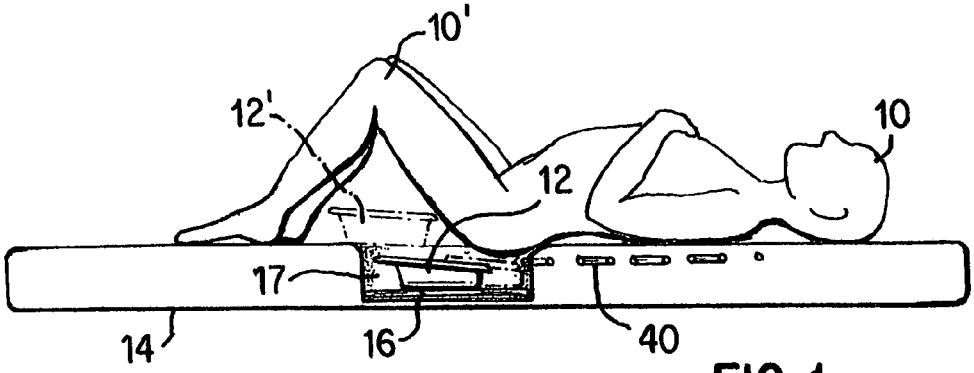
FIG. 1 is a longitudinal cross-section view, taken along line I—I of FIG. 3, of the mattress system of the present invention depicted with the addition of a bedpan, a bidet system and a person lying on the mattress
Figure 20:
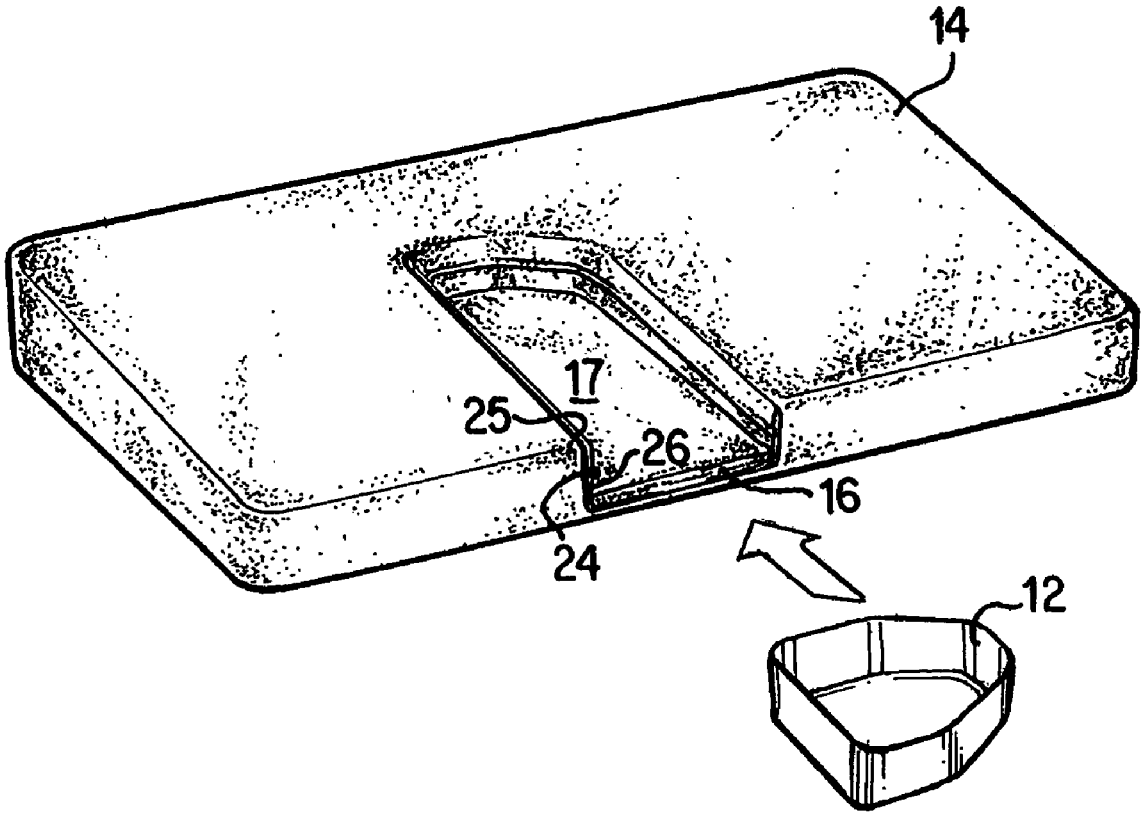
FIG. 20 is a top perspective view of the mattress according to another embodiment in which the cavity opening extends toward a lateral side surface of the mattress to allow for the lateral insertion of a bed pan.

In FIG. 1, a person 10 is shown lying on a mattress 14. The mattress 14 has a cavity 17 arranged in a central portion of the mattress 14 (FIG. 3) where a human waste container, such as a bedpan 12, would typically be arranged. Inside the cavity 17, an expandable cushion 16 (also known as a "bladder") is shown in its contracted state. The cushion 16 is attached to the bottom of the cavity 17 by an attachment 22. The cushion can be expanded, for example, by inflation with air, by filling with a liquid, or by mechanical measures such as with spring device. Arranged on the deflated cushion 16 is a bedpan 12, also shown in phantom 12', that fits in the cavity 17. The bedpan 12' can be inserted into the cavity 17 by an operator (user or attendant) who places the bedpan 12' into the cavity 17 between the person's legs 10', which may be bent if necessary to facilitate the process. FIG. 4A shows an enlarged detailed view of the bedpan 12 on the contracted cushion 16. Alternatively, as shown in FIG. 20, the cavity 17 can extend toward a lateral side surface of the mattress 14. In that manner, when the cushion 16 is in its deflated state, the bed pan 12 can be inserted from the side surface so as not to disturb the person on the mattress 14.

Figure 2:
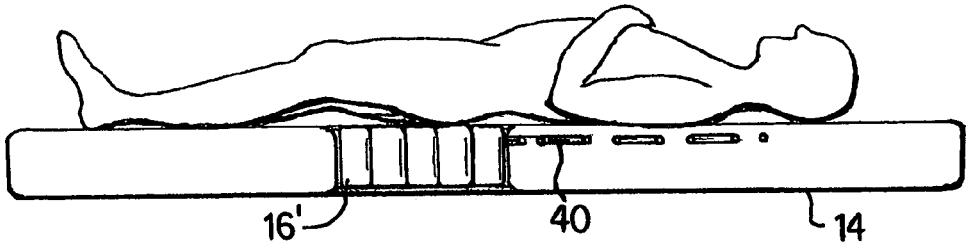
FIG. 2 is a longitudinal cross-section view of the mattress depicted in FIG. 1 with the bedpan removed and the cushion fully expanded according to the present invention.
Figure 3:
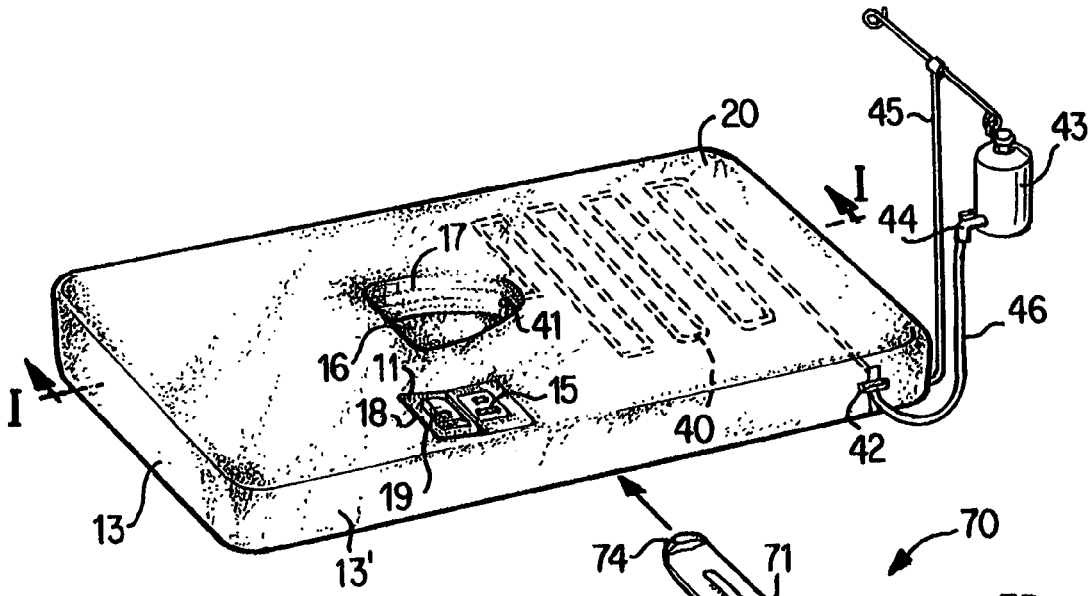
FIG. 3 is a top perspective view of the mattress according to the present invention showing the cavity, and the control switch used for expanding and contracting the cushion within the cavity, and the bidet system which includes a serpentine-like coil extending from the fluidic cleaning agent container, shown at the head of the bed, to the mattress cavity.
Figure 4A:
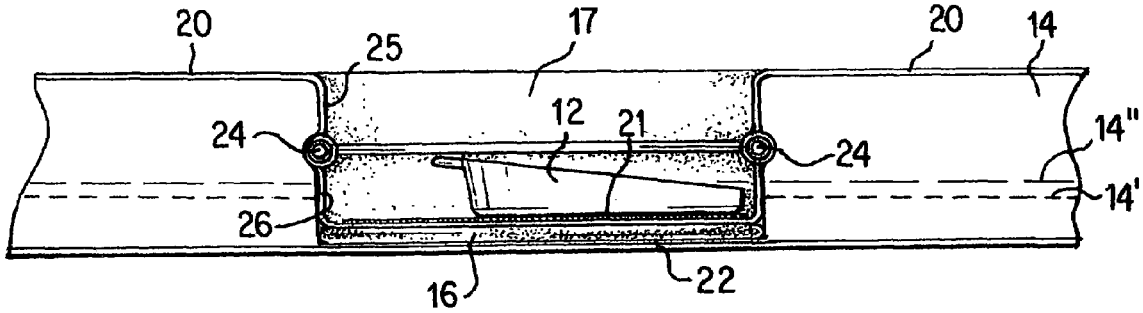
FIG. 4A is an enlarged detailed view of the mattress cavity with the bedpan positioned on top of the contracted cushion.

Referring to FIGS. 1, 2, and 3, the bidet system is depicted by pliable tubing 40 imbedded below the surface of the mattress in a serpentine-like coil. The pliable tubing 40 is embedded in the mattress 14 in the area where a person's upper torso is located when lying down on the mattress 14. By placing the pliable tubing 40 in this part of the mattress 14, the fluidic cleaning agent (for example water), running through the pliable tubing 40 is heated by the warmth of the person's body. The pliable tubing 40 terminates close to the top of the cavity 16 with an outlet port 41 that may include a spray nozzle (not shown) for distributing the fluidic cleaning agent upon the part of the person's lower body exposed within the mattress cavity 16. The fluidic cleaning agent is stored in a container 43 that is connected to the bed frame 45. The container 43 has an operative mechanism 44 from which the fluidic cleaning agent is released into a feeder connector 46. An inlet port having a valve mechanism 42 regulates the flow of the fluidic cleaning agent from the feeder connector 46 to the pliable tubing 40. The valve mechanism can be arranged on the side of the mattress 14 such that it is operable by the person using the bedpan or wastebag system.

Figure 3A:
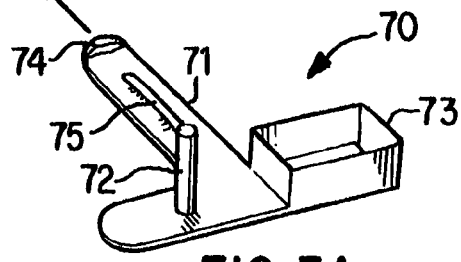
FIG. 3A is a schematic view of an attachment to the mattress that includes a tissue holder and a container for hand-wipes.

To facilitate the person's ability to clean himself or herself when using the bidet system of the present invention, a tissue holder 70 can be attached to the mattress 14 as depicted in FIG. 3A. The tissue holder 70 has an attachment 71 to provide support for a peg 72 to accommodate a roll of tissue and a container 73 to hold hand wipes. The attachment 71 is, for example, supported on the bottom part of the mattress 14 through sliding and locking retainer means, shown schematically as 74, 75, that anchor the attachment 71 to the underside of the mattress 14.

Figure 4B:
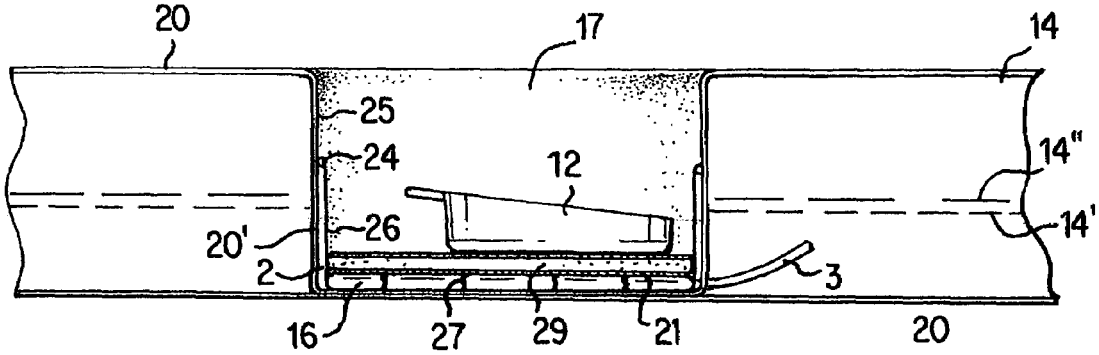
FIG. 4B is another embodiment of the invention as depicted in FIG. 4A showing the bedpan positioned on top of a mattress-like product.
Figure 5A:
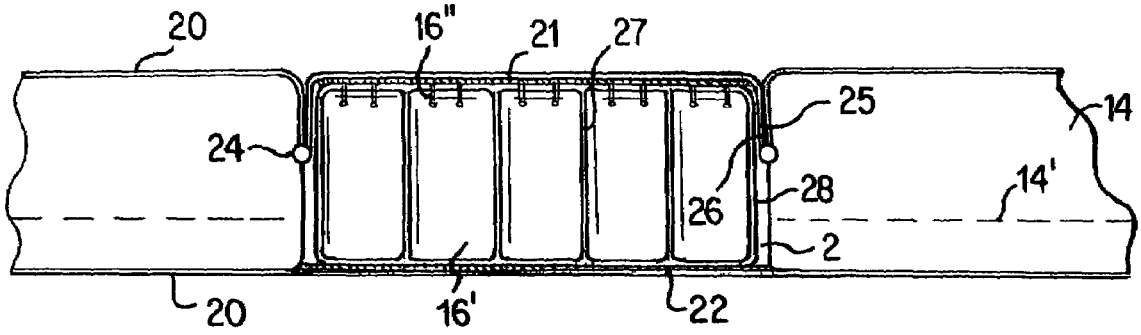
FIG. 5A is an enlarged detailed view of the mattress cavity with the cushion fully expanded within the cavity.

Referring to FIGS. 3, 4A and 4B, and 5A and 5B, the mattress 14 is shown covered with a mattress protector 20. In the embodiment depicted in FIGS. 4A and 5A, that portion of the mattress protector 20 extending into the cavity 17 is made of a pliable material 25, 26. The pliable material 25, 26 is attached to a retainer 24, depicted as a hoop or a ring. The retainer 24, which may be made of a flexible material, is recessed in the cavity 17 between the top and bottom surfaces of the mattress 14 on the periphery of the cavity 17. The retainer 24 is shown in FIGS. 4A and 5A in a position halfway between the top of the mattress 14 and the top of the cushion 16 in its deflated state. The bottom half of the pliable material 26 is attached to the top of the cushion 16 by way of an attachment 21 (for example Velcro®) (FIG. 4A). As a result of the attachment of the pliable material 25, 26 to the retainer 24, when the cushion 16 is expanded, the part of the pliable material 26 below the retainer 24 raises with the top of the cushion 16 while the part of the pliable material 25 above the retainer 24 stays in place (FIG. 5A). With this configuration, any spills or leaks which occur, either when the cushion 16 is contracted or expanded, will be contained within the pliable material 25, 26 of the mattress protector 20.

Figure 5B:
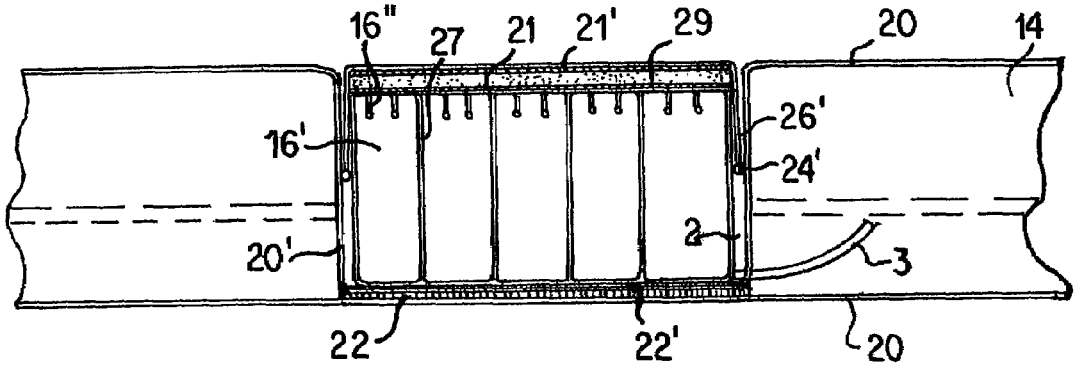
FIG. 5B is another embodiment of the invention as depicted in FIG. 5 showing a mattress-like product on top of the fully expanded cushion.

In the embodiment depicted in FIGS. 4B and 5B, the cushion is raised and lowered within an enclosure 2 in the cavity 17 of that part of the mattress 14. The enclosure 2 is the result of a two-layer configuration of the mattress protector 20 that extends into the cavity 17. The first layer is the mattress protector itself, which is provided with a retainer 24' and has a portion 20 above the retainer 24' and a portion 20' below the retainer 24'. The retainer 24' is shown in FIG. 4B and 5B in a position half-way between the top of the mattress 14 and the top part of the cushion 16 in its deflated state. The part of the mattress protector 20' below the retainer 24' is secured to the bottom of the cavity 17 by an attachment 22'. The second layer is a pliable material 26' that also extends into the cavity 17 and is, for example, sewn to the retainer 24' on the mattress protector 20'. As a result of the attachment of the pliable material 26' and the mattress protector 20' to the retainer 24', when the cushion 16 is expanded, the pliable material 26' below the retainer 24' raises with the top of the cushion 16 while the part of the mattress protector 20' below the retainer 24' stays in place thus forming the enclosure 2. With this configuration, any spills or leaks which occur, either when the cushion 16 is contracted or expanded, are contained within the pliable material 26' of the mattress protector 20.

Referring to FIGS. 4A, 4B, 5A and 5B, the mattress 14 is shown with a maximum compression point 14" above an indenture load deflection plane 14'. A traditional mattress material may be provided above the deflection plane 14' and a firmer material may be provided below the deflection plane 14'. With this configuration, when the mattress 14 is compressed to its maximum compression point 14", there remains sufficient clearance between the maximum compression point 14" and the inflection plane 14' to position the bedpan 12 in the cavity 17.

Referring to FIGS. 5A and 5B, the cushion 16 may be equipped with vertical I-beams 27. The vertical I-beams 27 add to the stability of the fully expanded cushion 16 by forming a series of expandable chambers 16' within the cushion 16. The cushion 16, which may be made of a pliable material, is configured to expand when the cushion 16 is inflated and to contract when the cushion 16 is deflated. The expansion and contraction of the cushion 16 may be controlled by, for example, a device 3 (FIGS. 4B and 5B). The cushion 16 may also be equipped with an elastic material 28 at least on the sides of the cushion 16 to prevent deformation of the cushion 16 during expansion and contraction. The elastic material 28 is configured to stretch when the cushion 16 is inflated and to contract when the cushion 16 is deflated. To ensure that the fully expanded cushion 16 is of the same tactile consistency as the rest of the mattress 14, the top of the cushion 16 may be provided with a mattress-like product 29 (FIG. 5B). The mattress-like product 29 is attached to the top of the cushion 16 and the bottom of the mattress protector 20 by attachments 21, 21'. If desired, the cushion 16 and/or expandable chambers 16' may be filled with a foam material (not shown).

Referring to FIGS. 5A and 5B, ventilation openings 16" can be provided in the mattress protector 20 (see FIG. 6 also) and in the expandable cushion 16 to help maintain a dry condition and provide stimulation to the area of the hips. In the embodiment shown in FIG. 5B, the ventilation openings 16" are arranged on lateral sides of the cushion 16 in view of the use of the mattress-like product 29. Use of the ventilation openings 16" in an inflatable cushion 16 requires constant or intermittent use of an inflation source, such as an air pump. By constantly or intermittently using an air pump, the need for an absolutely air-tight cushion 16 is eliminated.

Figure 18:
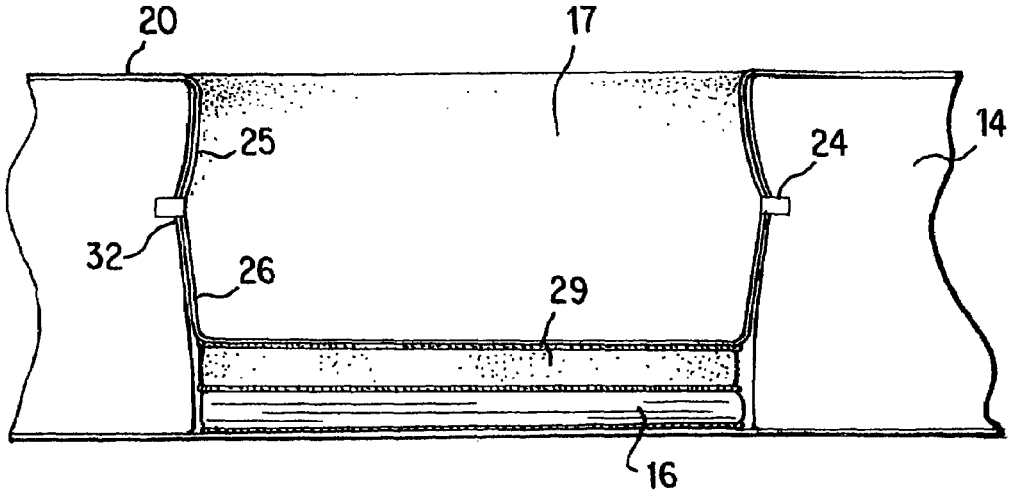
FIG. 18 is an enlarged detailed view of an alternative embodiment of the present invention showing the mattress cavity equipped with a retainer having a diameter larger than that of the cavity.
Figure 19:
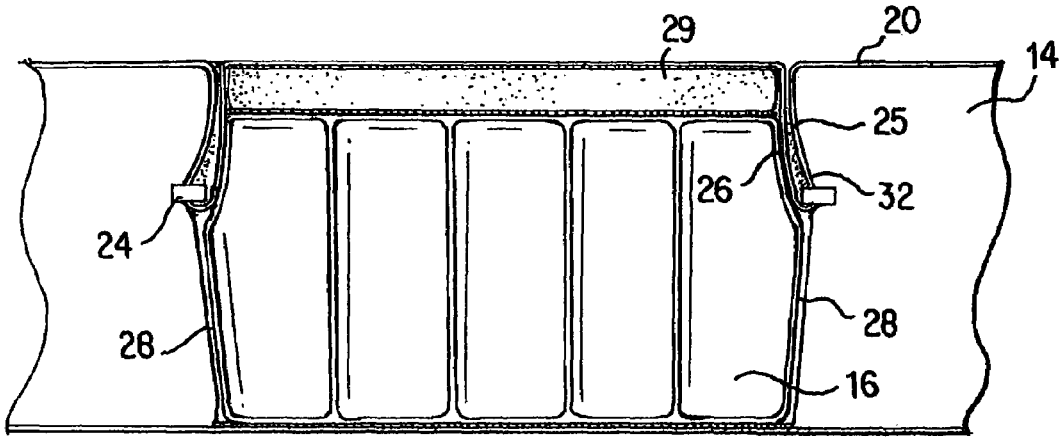
FIG. 19 is an enlarged detailed view of the mattress cavity as depicted in FIG. 18 with the cushion fully expanded within the cavity.

FIGS. 18 and 19 show an alternative embodiment of the mattress cavity 17 with the retainer 24 having a diameter or circumference greater than that of the cavity 17. The larger diameter of the retainer 24 causes an indenture 32 in the cavity 17 that serves to secure the retainer 24 within the cavity 17. The indenture 32 also provides extra room within the cavity 17 thus facilitating the expansion and contraction of the mattress-like product 29 on top of the cushion 16. When the cushion is fully expanded, the elastic material 28 contours against the indenture 32 (FIG. 19).

Figure 13:
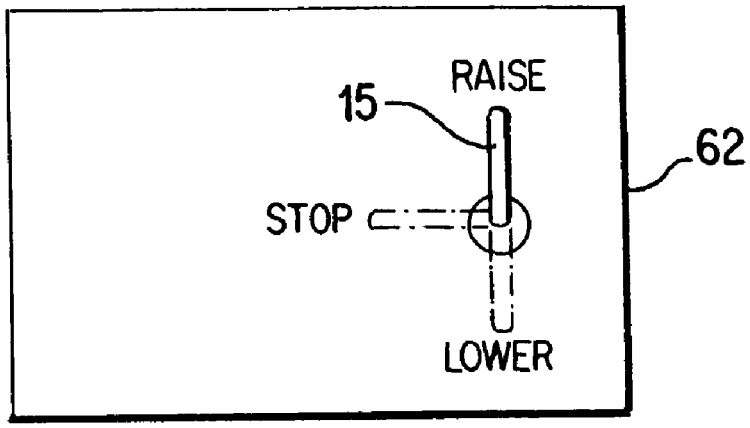
FIG. 13 is a detailed view of a control switch for use with the present invention.

The expansion and contraction of the cushion 16 is controlled by a control switch 15 which is depicted in FIG. 13. The control switch 15 can be located on the top of the mattress 14 (FIG. 3), on one of the sides 13, 13' of the mattress 14, or in any accessible location. Moreover, the switch can be a remote control device (not shown).

Figure 14:
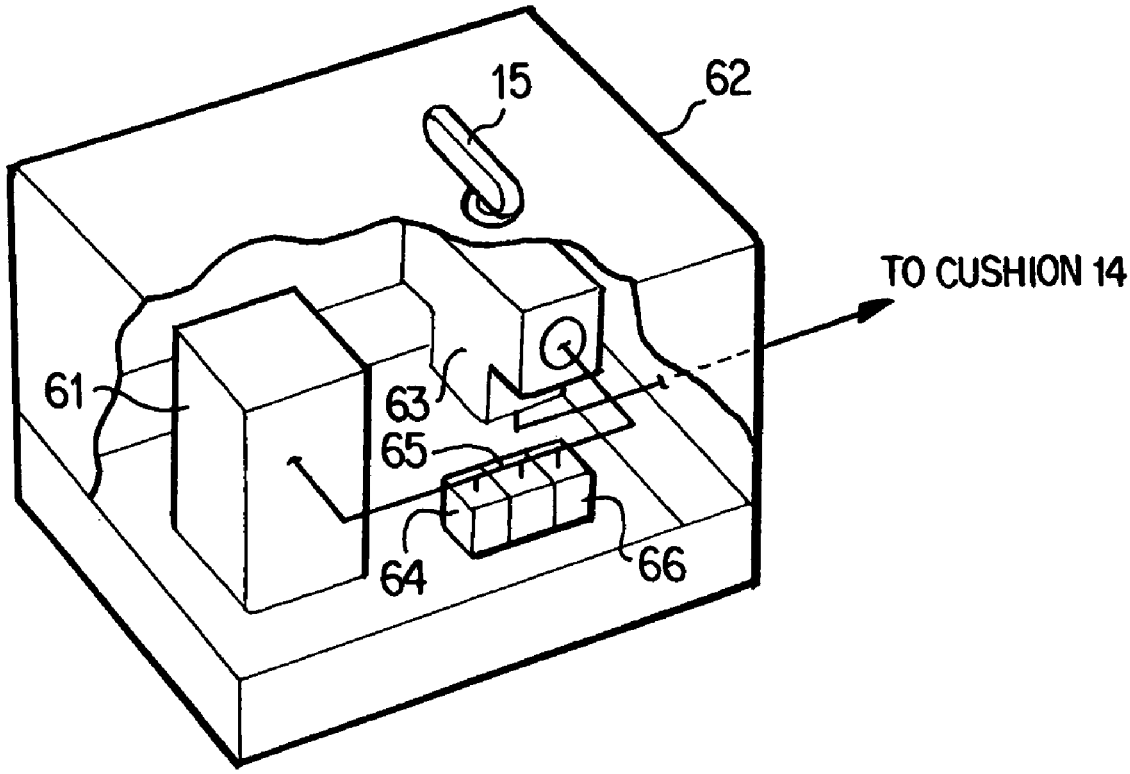
FIG. 14 is a cutaway perspective view illustrating the internal components of the control system operable with the control switch depicted in FIG. 13.

Referring to FIG. 14, the control switch 15 is shown as part of a control unit 62. The control unit 62 may be housed within the mattress 14 or its support structure. Alternatively, it may be attached to a side of the mattress 14, or the support structure thereof. The depicted control unit 62 is an inflation and deflation mechanism wherein the control switch 15 is attached to a three-way valve 63. The three way valve 63 controls the operation of an air pump 61 and an air release mechanism 64. As part of the air release mechanism, which may be a spring-loaded valve for example, are an air reservoir 65 and an air pressure switch 66. The air reservoir can be, for example, one manufactured by Industrial Specialties Mfg. (Part No. PA-305) of Englewood, Colo., and the air pressure switch can be, for example, one manufactured by World Magnetics (Part No. PSF 103) of Traverse, Mich. The air pressure switch 66 operates to automatically turn the air pump 61 on and off at a predetermined pressure setting. The air reservoir 65 operates to maintain a relatively constant pressure in the system so that the air pump 61 does not frequently cycle on and off. Together, as part of the air release mechanism 64, the components allow the cushion 16 to be adjusted in accordance with the weight of the user. This ensures that the cushion 16 provides substantially the same level of support as that of the surrounding conventional mattress. For example, when a heavy user rests on the mattress 14, its coils will contract whereas the air cushion 16, without such control, would maintain an expanded state under increased pressure. In order to avoid this potentially uncomfortable problem, the air release mechanism 64 operates to bleed-off the increased air pressure in the cushion 16 to a defined level. At the same time, the air pressure switch 64 operates to turn the air pump 61 on when necessary to maintain that pressure. The use of these components allows the user to maintain the control switch 15 in the "raise" position when the bed pan is not being used.

In operation, when the control switch 15 is on RAISE, the port in the 3-way valve 63 opens from the pump 61 to the cushion 16, thereby activating the electric air pressure switch 66 (which is set at a predetermined pressure) to switch automatically. This starts the air pump 61 in order to inflate the air cushion 16 to the appropriate set pressure, at which the set pressure then opens the electric air pressure switch 66, thus cutting-off the air pump 61.

When the control switch 15 is on LOWER, the port in the 3-way valve 63 is closed going from the pump 61 to the cushion 16. However, the port from the cushion 16 going to the exhaust in the 3-way valve 63 is open, allowing the cushion 16 to deflate. This then allows the user to position the bedpan 12 in the cavity 17.

Also, with the control switch 15 on LOWER, the electric pressure switch 66 is open, since the pressure in the air reservoir 65, which reservoir contains a volume of air, is at the predetermined pressure setting. Thus, by using the air reservoir 65, the air pressure switch 66 is prevented from cycling on and off.

When the control switch 15 is on STOP, the ports to both the cushion 16 and the pump 61 are closed. One typically places the control switch 15 into the STOP position when it is desired to raise the cushion 16 only until it reaches a certain position, such as so that bedpan 12 touches the person, or to position the top of the cushion to enhance the relief and healing of the coccyx and/or skin irritation of the person.

As noted above, the air release mechanism 64 compensates for the weight of a person by releasing the compressed air caused by the pressure in the air cushion 16, which pressure in the cushion is desired to be maintained at a fraction above the predetermined air pressure setting for the air pressure switch 66 and is adjusted in proportion to the firmness of the mattress 14.

The air pump 61 and air release mechanism 64 thus are used to inflate and deflate the cushion 16 as outlined above. A switchable vacuum pump may also be used to deflate the cushion 16 (not shown). If an air pump 61 or a vacuum pump is used, it may be desirable for the cushion 16 and/or the expandable chambers 16' to be filled with a foam material. As alternative embodiments, the control unit 62 may house a fluidic pump or the control switch 15 may be used to control a mechanical mechanism, such as a spring device, located within the cushion 16 (not shown). Of course, any known mechanisms that may operably expand the cushion can be used within the context of the present invention.

Figure 6:
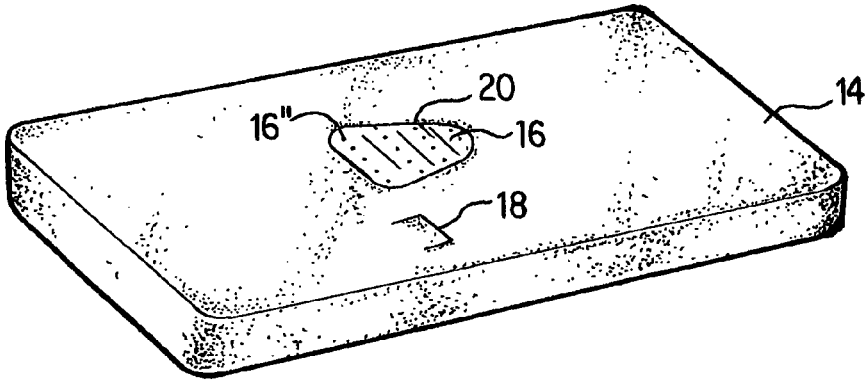
FIG. 6 is a top perspective view of the mattress, expanded cushion, and the control switch covered by a mattress protector.

FIGS. 3 and 6 depict the control switch 15 positioned on the top of the mattress 14. To provide access to the control switch 15 when it is in this position, the mattress protector 20 is provided with a flap 18. The flap 18 can be opened and closed to expose and conceal the control switch 15, respectively. The flap 18 is provided with a thick padding 19 and an attachment 11 (for example, Velcro®). When the flap 18 is closed, the attachment 11 secures the flap 18 to the mattress protector 20 and the thick padding 19 ensures that the control switch 15 cannot be felt through the top of the mattress 14.

Figure 7:
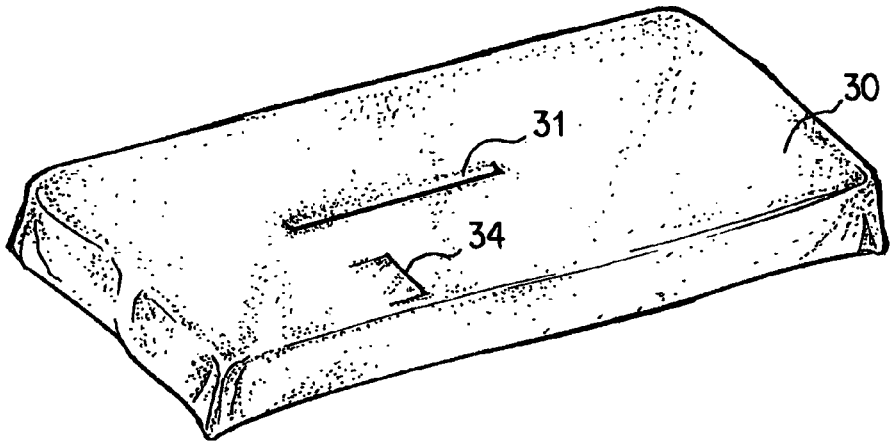
FIG. 7 is a top perspective view of the mattress with a bedsheet having openings providing access to the cavity and to the control switch.
Figure 8:
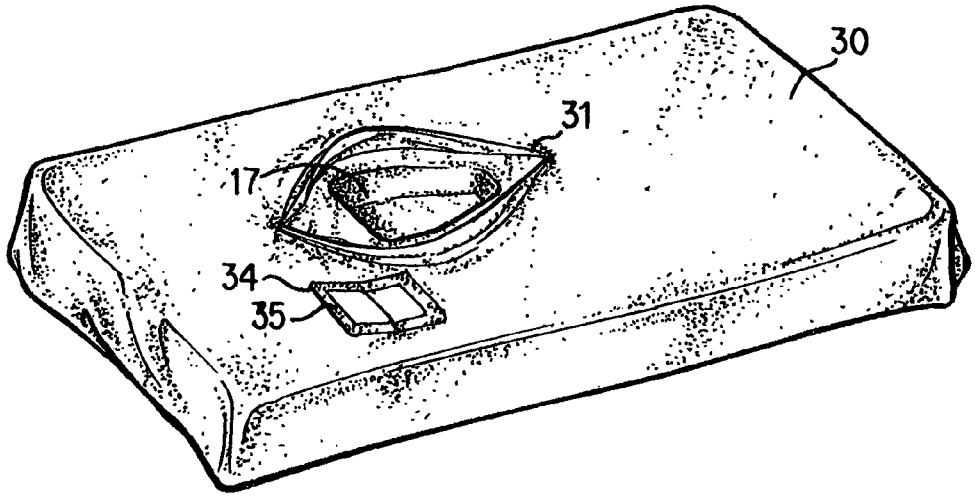
FIG. 8 is a top perspective view of the bedsheet depicted in FIG. 7 shown in its open state allowing access to the cavity and control switch.
Figure 15:
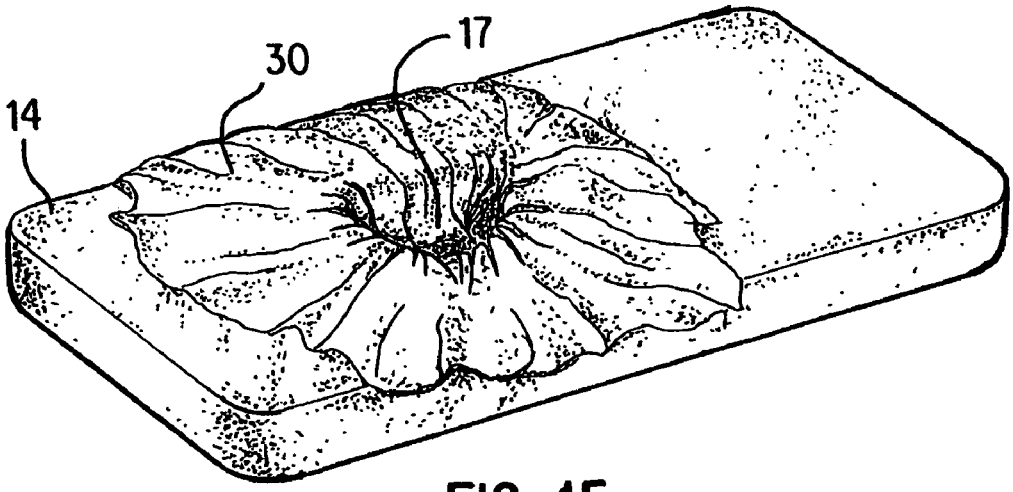
FIG. 15 is another embodiment of the invention depicted in FIGS. 7 and 8 showing a bedsheet gathered into the cavity prior to the placement of the bedpan or wastebag system.
Figure 16:
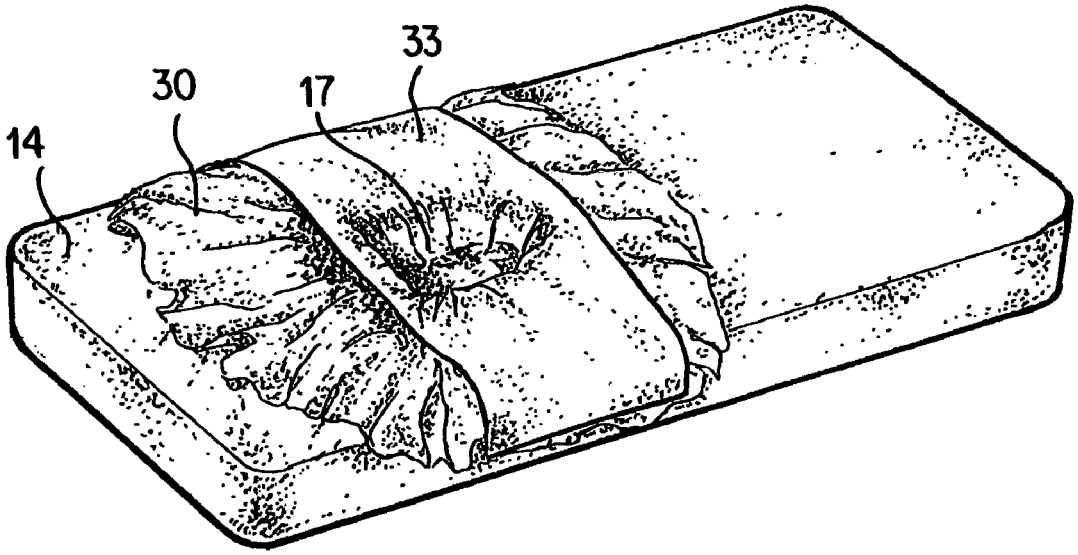
FIG. 16 is another embodiment of the invention depicted in FIG. 15 with an underpad positioned on top of the gathered bedsheet.

FIGS. 7 and 8 depict the bedsheet 30 for use with the mattress system of the present invention. The bedsheet 30 is provided with a slit which is closed by a fly or a flap 31. The fly or flap 31 may be secured to the bedsheet 30 with an attachment (not shown). When the sides of the fly or flap 31 are pulled apart, the cavity 17 is exposed. The bedsheet 30 may also be provided with a flap 34 to provide access to the control switch 15, the flap 34 being secured to the bedsheet 30 with an attachment 35 (for example, Velcro®) when closed. As an alternative to the bedsheet equipped with the fly 31, a traditional bedsheet 30 may be used (FIG. 15). In this embodiment, the bedsheet 30 is gathered into the cavity 17 of the mattress 14 prior to the placement of the human waste container into the cavity 17. For added protection of the bedsheet from accidental spills, an underpad 33 may be placed on top of the gathered bedsheet 30 (FIG. 16).

Figure 9:
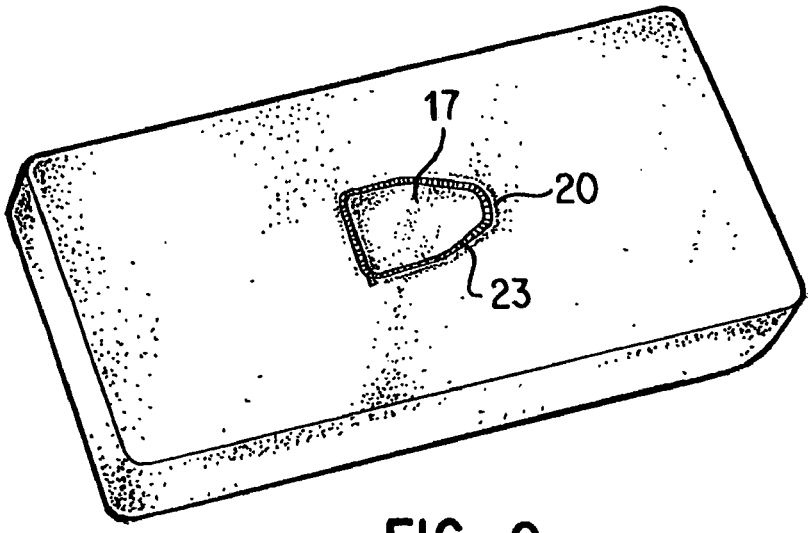
FIG. 9 is a perspective view of the bottom portion of the mattress according to the present invention having a zippered access to the cavity.

Referring to FIG. 9, the bottom of the mattress 14 may be provided with a zippered opening 23 to facilitate the removal of the cushion 16 for cleaning, replacement, or if it is no longer needed.

Figure 10:
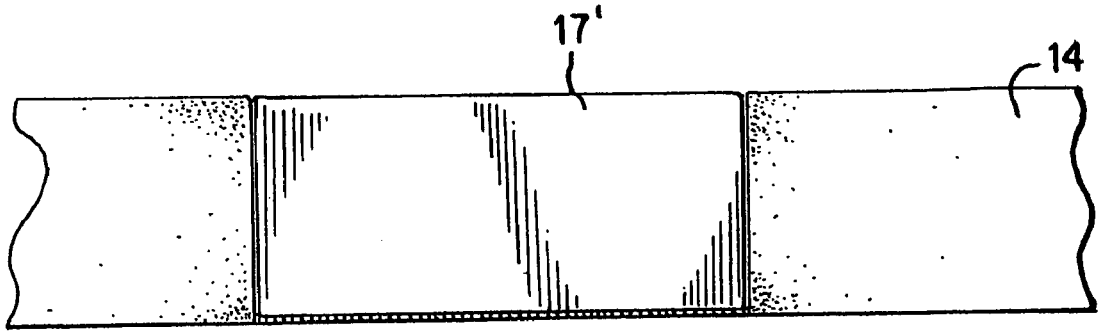
FIG. 10 is an enlarged detailed view illustrating a mattress-like product according to the invention, which fills the cavity when the mattress system of the present invention is not in use.

Referring to FIG. 10, a mattress cavity plug 17' can be inserted into the cavity 17 thereby turning the mattress 14 according to the present invention into a conventional mattress when the cavity cushion system of the present invention is not needed.

Figure 11:
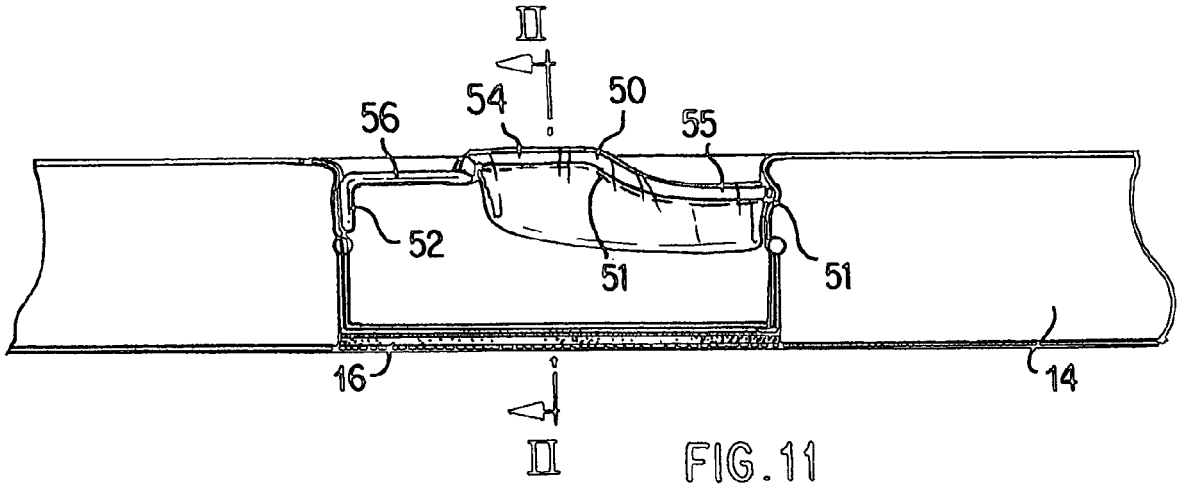
FIG. 11 is an enlarged detailed view of an alternate embodiment according to the invention in which a wastebag is used instead of a bedpan.
Figure 11A:
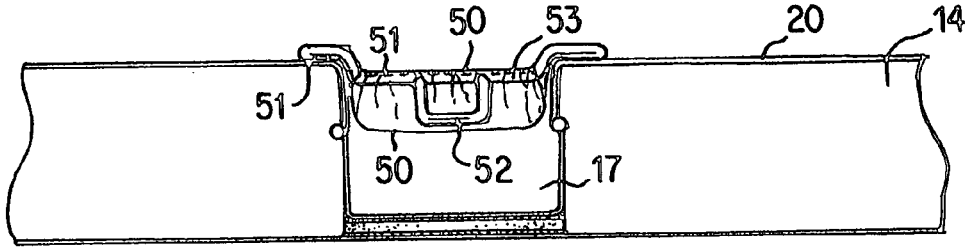
FIG. 11A is a cross sectional view taken along lines II—II of the mattress and wastebag system depicted in FIG. 11.
Figure 12:
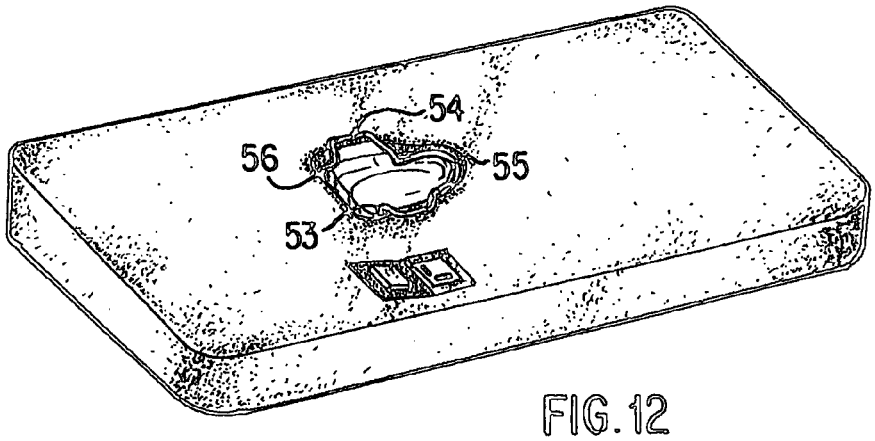
FIG. 12 is a top perspective view of a mattress having a cavity equipped with the wastebag system, and a control switch for expanding and contracting the cushion in the cavity according to the present invention.
Figure 17:
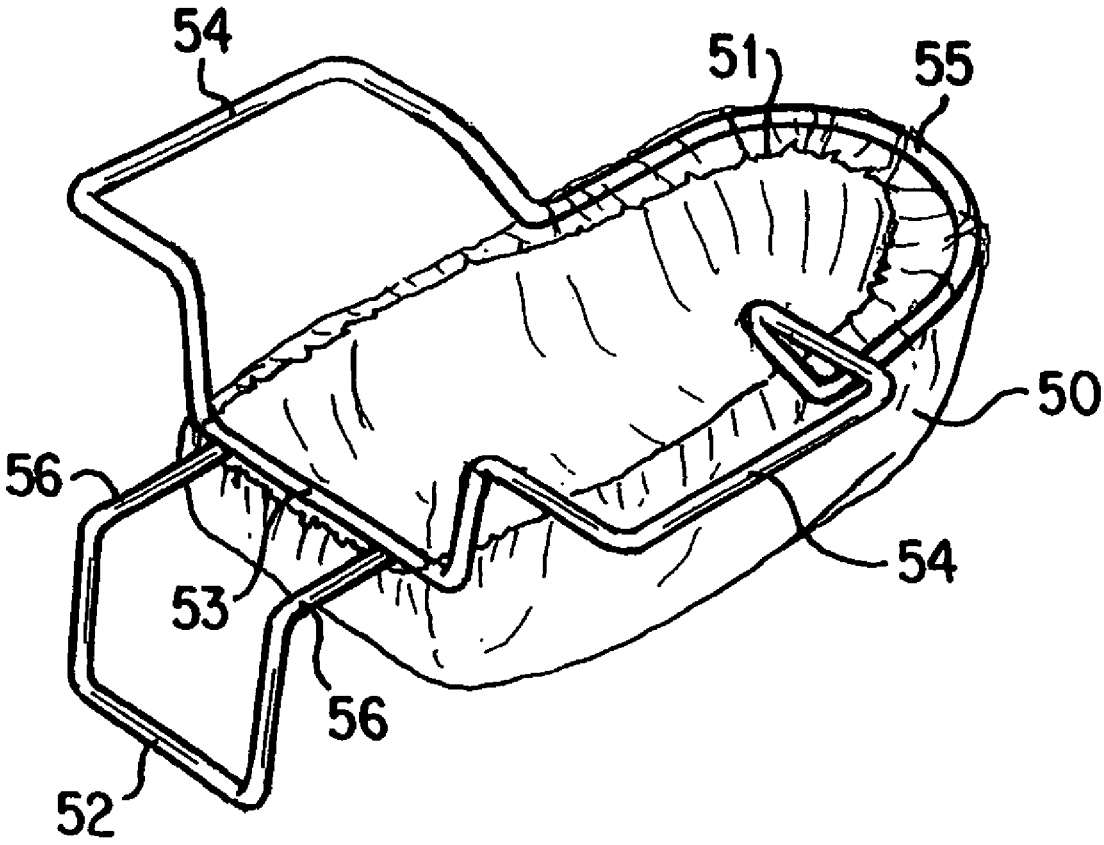
FIG. 17 is an enlarged perspective view of wastebag system according to the present invention.

FIGS. 11, 12, and 17 describe an alternative embodiment using a wastebag 50 as the human waste receptacle. In this embodiment, a support ring 53–55 mates with the cavity 17 under spring tension. One portion of the support ring 54 is supported on the top surface of the mattress, another portion 55 extends into the cavity 17, and a third portion 53 completes the ring 53–55. The wastebag 50 is secured to the ring 53–55 by means of an elastic material 51. To facilitate the placement and removal of the support ring 53–55 into the cavity 17, a handle 56 extends from the support ring 53–55. The handle 56 acts like a spring so as to be under tension when the end of the handle 52 engages the cavity 17.

The operation of the mattress and cavity cushion system will now be described in conjunction to the figures. When the person 10 needs to use a human waste container such as a bedpan 12 or a wastebag 50, the operator exposes the cavity 17 by pulling each side 32 of the fly or flap 31 on the bedsheet 30. This exposes the cavity 17 with the fully expanded cushion 16 (FIGS. 6–8). The operator then uses the remote control device or the control switch 15 to contract the cushion 16. If the control switch 15 is located on the mattress 14, the operator pulls back the flap 34 on the bedsheet 30 to expose the flap 18 on the mattress protector 30 which in kind is pulled back to expose the control switch 15.

Once the cushion 16 is deflated, the operator is ready to insert the bedpan 12 or wastebag system 52–56 into the cavity. If a bedpan 12 is being used, the operator positions the bedpan 12 on the deflated cushion 16 within the cavity 17 (FIG. 1). It may be necessary to bend the person's knees 10' in order to position the bedpan 12. The remote control device or the control switch 15 is then used to expand the cushion 16 until the bedpan 12 is directly under the person 10. If the wastebag system is being used, upon contraction of the cushion 16, the operator will secure the support ring 52–56 with the attached wastebag 50 to the cavity 17. During use of the wastebag system 52–56, the cushion 16 is left in its deflated state.

When the person has completed using the bedpan 12 or wastebag system 52–56, the bedpan 12 or wastebag system 52–56 is removed and a clean bedpan 12 or wastebag system 52–56 may be placed in the cavity 17 for use while cleaning the person 10.

If the mattress is equipped with the bidet system, the operator can turn on the bidet system so that the fluidic cleaning agent can clean that part of the person's body exposed within the cavity 17. The operator (such as the person lying on the bed or an attendant) activates the bidet system by turning a valve 42 that releases the fluidic cleaning agent from a storage container 43 into the pliable tubing 40 within the mattress 14. When the fluidic cleaning agent reaches the end of the pliable tubing 40 at the mattress cavity 17, it is expelled into the cavity 17 in the direction of the person's lower body exposed therein. When the person has finished using the bidet system, the operator may complete cleaning and drying the person by taking advantage of tissue paper and hand wipes placed on the peg 72 and container 73, respectively, of the attachment 71.

After the person 10 has been cleaned, the operator removes the bedpan 12 or wastebag system 52–56 from the cavity 17 and uses the remote control or control switch 15 to fully expand the cushion 16. If the control switch 15 is located on the mattress, the operator then closes the flap 18 of the mattress protector 20 and the flap 34 of the bedsheet 30. Lastly, the operator closes the fly 31 of the bedsheet 30.

If the bedsheet embodiment of FIGS. 15 and 16 is used, then the operator gathers a bedsheet 30 into the cavity 17 and if desired, places an underpad 33 across the mattress so that it extends into the cavity 17. After this is done, the bedpan or wastebag system can be used as described above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mattress system, comprising:

a mattress having a top surface and a bottom surface;

a cavity arranged in the mattress, the cavity being open at the top surface and having a defined size;

an expandable cushion arranged in the cavity;

a mattress protector covering at least the top surface of the mattress, the protector including a first portion that extends into the cavity and a second portion that extends over the expandable cushion arranged in the cavity; and a control system operatively coupled with the cushion to control an expansion and contraction of the cushion in order to maintain a cushion pressure in accordance with a weight of a user in proportion to a firmness of the mattress, wherein the control system includes a fluidic pump arranged to pump fluid into the expandable cushion, a fluid relief mechanism arranged to allow fluid to escape the expandable cushion, and a fluid pressure switch operable to automatically maintain a defined pressure level in the expandable cushion.

2. The system according to claim 1, wherein the fluid is air, and wherein a control switch is provided to control an inflation and deflation of the expandable cushion.

3. The system according to claim 2, wherein the control switch is an electric control switch.

4. The system according to claim 1, further comprising a fluid pressure reservoir operatively coupled with the control system.

5. The system according to claim 1, wherein the fluid is air.

6. The system according to claim 1, wherein the fluid is a liquid.

7. The system according to claim 1, wherein the fluid relief mechanism allows the fluid to escape the expandable cushion to maintain the defined pressure level.

8. A mattress system, comprising:

a mattress having a top surface and a bottom surface and a defined firmness;

a cavity arranged in the mattress;

an expandable cushion arranged in the cavity; and a control system operatively coupled with the cushion to control an expansion and contraction of the cushion in order to maintain a cushion pressure in accordance with a weight of a user in proportion to the firmness of the mattress, wherein the control system includes a fluidic pump arranged to pump fluid into the expandable cushion, a fluid relief mechanism arranged to allow fluid to escape the expandable cushion, and a fluid pressure switch operable to automatically maintain a defined pressure level in the expandable cushion.

* * * * *